US008518131B2

(12) United States Patent
Mattingly et al.

(10) Patent No.: US 8,518,131 B2
(45) Date of Patent: Aug. 27, 2013

(54) METHOD FOR MODIFYING THE VOLATILITY OF PETROLEUM PRIOR TO ETHANOL ADDITION

(75) Inventors: Larry D. Mattingly, Sanford, FL (US); Steven M. Vanderbur, Houston, TX (US)

(73) Assignee: Sunoco Partners Butane Blending LLC, Philadelphia, PA (US)

( * ) Notice: Subject to any disclaimer, the term of this patent is extended or adjusted under 35 U.S.C. 154(b) by 0 days.

(21) Appl. No.: 13/466,477

(22) Filed: May 8, 2012

(65) Prior Publication Data

US 2012/0216453 A1 Aug. 30, 2012

Related U.S. Application Data

(62) Division of application No. 12/569,698, filed on Sep. 29, 2009, now Pat. No. 8,192,510.

(60) Provisional application No. 61/144,379, filed on Jan. 13, 2009.

(51) Int. Cl.
*C10L 1/18* (2006.01)
*G01N 7/00* (2006.01)

(52) U.S. Cl.
USPC ..... 44/451; 73/29.01

(58) Field of Classification Search
USPC ..... 73/29.01; 44/451
See application file for complete search history.

(56) References Cited

U.S. PATENT DOCUMENTS 6,258,987 B1 * 7/2001 Schmidt et al. ..... 585/3
6,679,302 B1 * 1/2004 Mattingly et al. ..... 141/104
7,032,629 B1 * 4/2006 Mattingly et al. ..... 141/9

* cited by examiner

*Primary Examiner* — Pamela H Weiss
(74) *Attorney, Agent, or Firm* — Clark G. Sullivan; Arnall Golden Gregory LLP

(57) ABSTRACT

The invention relates to systems and methods for modifying the volatility of petroleum prior to ethanol addition. The methods can include (a) providing (i) a supply of gasoline, (ii) an ethanol standard, and (iii) a supply of butane; (b) analyzing the volatility of a sample formed by mixing the gasoline and ethanol standard; (c) calculating from the volatility a ratio of butane that can be blended into the sample without causing the sample to pass the one or more fixed volatility limits; and (d) blending butane from the butane supply with gasoline from the gasoline supply at or below the ratio calculated in step (c).

7 Claims, 3 Drawing Sheets

METHOD FOR MODIFYING THE VOLATILITY OF PETROLEUM PRIOR TO ETHANOL ADDITION

This application is a division of and claims priority to issued U.S. Pat. No. 8,192,510, entitled "Method for Modifying the Volatility of Petroleum Prior to Ethanol Addition, filed on Sep. 29, 2009, which claims the benefit of U.S. provisional application Ser. No. 61/144,379 filed on Jan. 13, 2009, all of which are incorporated herein by reference.

FIELD OF THE INVENTION

The present invention relates to processes and systems for blending butane, and other volatility modifying agents, into a supply of petroleum that is intended for blending with ethanol.

BACKGROUND OF THE INVENTION

Figure 1:
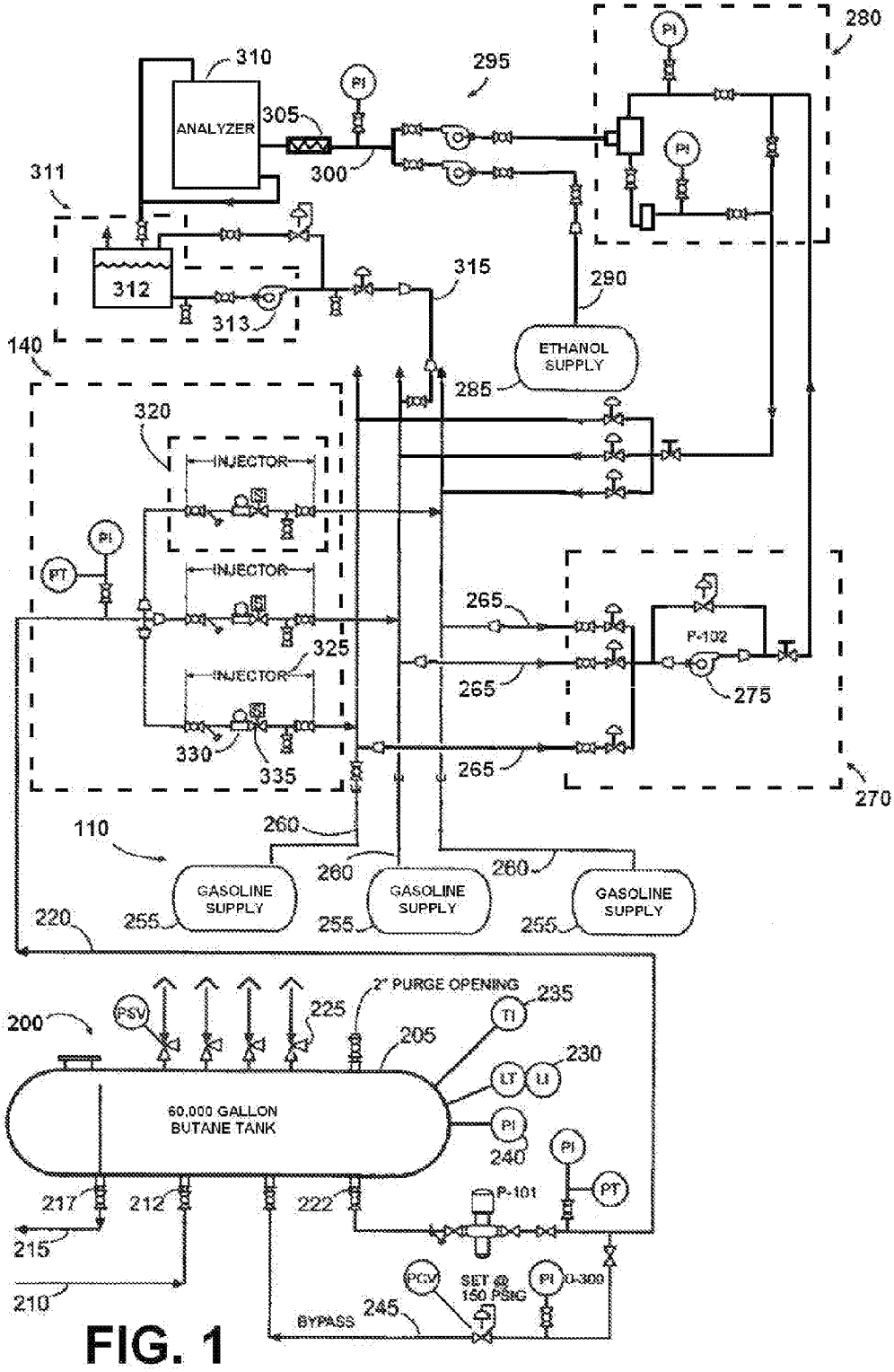
FIG. 1 is a functional block diagram illustrating the architecture and components of an exemplary embodiment of a butane, ethanol, and gasoline blending system

Recent high gasoline prices and increased consumer demand have resulted in numerous efforts to reduce our dependence on petroleum as a source of energy. Ethanol, and the blending of ethanol with gasoline used to fuel our automobiles, holds substantial promise at reducing our consumption of petroleum. In fact, ethanol blending is mandated by the federal and state governments in many cases.

Unfortunately, the blending of ethanol into our petroleum supply has created its own set of problems, particularly for air quality control. The problem is that there are multiple suppliers of ethanol and gasoline in the petroleum distribution system, and that the ethanol and gasoline from different suppliers can react differently, to produce different physical properties for the blend, particularly in terms of volatility, a key component of any air quality control program.

The problem is magnified when other components of our petroleum supply, such as butane, are factored in. Butane is often added to the gasoline supply to improve its combustibility and to decrease its overall cost, but butane blending is only permissible under certain conditions, and at certain times of year, based on air quality specifications. The fact that ethanol will be added to the gasoline after butane is blended only complicates the matter, because butane must be blended based on an interaction between gasoline and ethanol that cannot be predicted in advance.

Furthermore, ethanol, unlike gasoline, is not suitable for transportation through pipelines because of its high affinity for water, and is most often blended with gasoline after it has been transported and blended with butane. In view of this imprecision, gasoline suppliers are unable to optimize the amount of butane that they can blend with gasoline. Thus, a need exists for the ability to blend butane with gasoline that is to be mixed with ethanol in an amount that does not cause the final blend to exceed predetermined volatility limits.

There are three principal methods for assessing the volatility of gasoline: (1) measuring the vapor to liquid ratio, (2) measuring the vapor pressure, and (3) measuring the distillation temperature. The Reid method is a standard test for measuring the vapor pressure of petroleum products. Reid vapor pressure (RVP) is related to true vapor pressure, but is a more accurate assessment for petroleum products because it considers sample vaporization as well as the presence of water vapor and air in the measuring chamber. The distillation temperature is another important standard for measuring the volatility of petroleum products. When blending gasoline with volatility modifying agents, the distillation temperature ($T_D$) often cannot fall below a prescribed value. $T_D$ refers to the temperature at which a given percentage of gasoline volatilizes under atmospheric conditions, and is typically measured in a distillation unit. For example, the gasoline can be tested for T(50), which represents the temperature at which 50% of the gasoline volatilizes, or it can be measured at T(10), T(90), or some other temperature value.

Several methods have been attempted to improve the precision of blending and the predictability of the volatility of the final product. The Grabner unit is a substantial advance in this respect. The Grabner unit (manufactured by Grabner Instruments) is a measuring device capable of providing Reid vapor pressure and vapor to liquid ratio data for a gasoline sample typically within 6-11 minutes of introducing the sample to the unit. The Distillation Process Analyzer (DPA) is another advance. The DPA (manufactured by Bartec) is a measuring device capable of provided a distillation temperature for a gasoline sample, typically within about 45 minutes of introducing the sample to the unit.

U.S. Pat. Nos. 7,032,629 and 6,679,302, PCT Patent Application No. WO 2007/124058, and U.S. Patent Application No. 2006/0278304 relate to methods and systems for blending butane and gasoline that ensure that the blended gasoline meets certain vapor pressure requirements. These references do not teach how to blend gasoline with more than one volatility modifying agent, and do not teach how to blend butane with gasoline that will subsequently be blended with ethanol.

U.S. Pat. No. 6,328,772 relates to the blending of gasoline and ethanol. The reference does not teach how to blend gasoline with more than one volatility modifying agent, and does not teach how to blend gasoline with butane.

Unfortunately, systems and methods have not been developed for mixing butane, ethanol, and gasoline to produce a blended gasoline that meets precise limits of volatility.

SUMMARY OF THE INVENTION

The inventors have made intensive study and analysis to overcome these problems, and have determined that the gasoline supply varies over time, and that the gasoline content is the primary variable affecting the volatility of the blended gasoline. Moreover, unlike butane, the influence of ethanol on gasoline cannot be predicted without first blending the ethanol and gasoline and analyzing the blend. The inventors have further discovered that the influence that butane will have on the volatility of the ultimate gasoline/ethanol blend can be predicted before the gasoline is blended with butane or ethanol, by: (1) preparing a sample of the gasoline supply and an ethanol standard, at the ratio at which the gasoline and ethanol will ultimately be blended (typically 90:10), (2) analyzing the volatility of the gasoline/ethanol sample, and (3) using the volatility of the gasoline/ethanol sample to perform a theoretical calculation of the effect that butane addition will have on the gasoline/ethanol mix.

Based on these discoveries, the inventors have developed methods and systems for blending butane into gasoline that is intended for ethanol blending, in a manner that maximizes the amount of butane that can be blended without exceeding or falling below (i.e. passing) pre-set volatility limits.

The versatility of these systems is unsurpassed. For blends that contain low levels of ethanol (for example, 90:10), the methods and systems can be used to calculate the maximum amount of butane that may be added to the blend without exceeding maximum volatility limits. For blends that contain high levels of ethanol (for example, E85), the methods and systems can be used calculate the amount of butane that may be added to the blend to meet minimum volatility limits. The methods even can be practiced far upstream from the ethanol blending process, at locations miles away from the eventual point of ethanol and gasoline blending, by providing an ethanol standard at the point where the gasoline/ethanol sample is analyzed, and using the standard to prepare the 90:10 sample that is analyzed for volatility.

In one embodiment, the invention provides a method of blending butane into a gasoline supply that also is mixed with a fixed ratio of ethanol, in an amount that does not cause the gasoline/ethanol mix to pass one or more fixed volatility limits selected from vapor pressure, vapor liquid ratio, T(10) and T(50), wherein the gasoline supply varies over time in terms of content and volatility potential, comprising:

a. providing (i) a supply of gasoline, (ii) an ethanol standard, and (iii) a supply of butane;
b. analyzing the volatility of a sample formed by mixing the gasoline and ethanol standard;
c. calculating from the volatility a ratio of butane that can be blended into the sample without causing the sample to pass the one or more fixed volatility limits; and
d. blending butane from the butane supply with gasoline from the gasoline supply at or below the ratio calculated in step (c).

Additional advantages of the invention are set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF THE INVENTION

Definitions and Methods of Measurement

Throughout this patent application, whenever an analysis of gasoline, butane, or ethanol is disclosed, the analysis can be performed in accordance with applicable EPA regulations and American Society for Testing and Materials ("ASTM") methods in force as of the date of this application. For example, the following ASTM methods can be used:

When volatility is measured according to the present invention, it will be understood that any suitable measure of vapor pressure can be taken, including Reid vapor pressure and/or vapor/liquid ratio. For measuring the Reid vapor pressure of reformulated gasoline, ASTM standard method D 5191-07 can be used. The following correlation can also be used to satisfy EPA regulations:

$$RVP_{EPA}=(0.956*RVP_{ASTM})-2.39\ kPa$$

For measuring the temperature at which a given percentage of gasoline is volatilized, ASTM standard D 86-07b, should be used. This method measures the percentage of a gasoline sample that evaporates, as a function of temperature, as the sample is heated up under controlled conditions. $T_D$ refers to the temperature at which a given percentage of gasoline volatilizes using ASTM standard D 86-07b as the test method, T(50) refers to the temperature at which 50% of gasoline volatilizes using ASTM standard D 86-07b as the test method, etc.

The term gasoline, when used herein, refers to any refined petroleum product that flows through a petroleum pipeline. The term includes any liquid that can be used as fuel in an internal combustion engine, non-limiting examples of which include fuels with an octane rating between 80 and 95, fuels with an octane rating between 80 and 85, fuels with an octane rating between 85 and 90, and fuels with an octane rating between 90 and 95. The term includes products that consist mostly of aliphatic components, as well as products that contain aromatic components and branched hydrocarbons such as iso-octane. The term also includes all grades of conventional gasoline, reformulated gasoline ("RFG"), diesel fuel, biodiesel fuel, jet fuel, and transmix. The term also includes blendstock for oxygenate blending ("BOB"), which is typically used for blending with ethanol. BOBs include RBOB (reformulated gasoline blendstock), PBOB (premium gasoline blendstock), CBOB (conventional gasoline blendstock), subgrade gasoline, and any other blendstock used for oxygenate or ethanol blending. Gasolines for ethanol blending can be gasolines used to create virtually any type of gasoline and ethanol blend. For example, the gasolines for ethanol blending can be used to create a gasoline:ethanol blend of a ratio of about 9 to 1, 4 to 1, 1 to 1, 1 to 4, 15 to 85, or 1 to 9. The term ethanol, when used herein, refers to any ethanol product that can be used in an ethanol and gasoline blend. The term thus includes starch based ethanol, sugar based ethanol, and cellulose based ethanol.

The term "gasoline supply," when used herein, refers to a source of gasoline from any storage tank or any point along a petroleum pipeline. The term includes gasoline from the line between a storage tank and the rack, gasoline from a pipeline that transmits multiple types of gasoline, and gasoline from a pipeline that transmits only one type of gasoline.

The term "ethanol standard," when used herein, refers to ethanol obtained from the ethanol supply that is to be mixed with the gasoline, or, alternatively, ethanol obtained from a second supply of ethanol that is not to be mixed with the gasoline.

The term "fixed," when used herein, refers to a previously determined value for a physical property of a blend. For example, when it is stated that a gasoline supply is to be mixed with a "fixed ratio" of ethanol, it is understood that it has been previously determined that the blend of gasoline and ethanol will have the ratio. Likewise, when it is stated that a blend has fixed volatility, it is understood that it has been previously determined that the blend will have the volatility.

The terms "fixed ratio," "fixed volatility limits," and like terms, when used herein, refer to a previously determined value that will be met by a blend. For example, when it is stated that butane is blended into a gasoline supply that also is mixed with a "fixed ratio" of ethanol, it is understood that it has been previously determined that the gasoline will be mixed with ethanol to make a blend that meets the ratio. Likewise, when it is stated that a ratio of butane is calculated that can be blended into a sample without causing the sample to pass a fixed volatility limit, it is understood that it has been previously determined that the sample mixed with the butane at the ratio will make a blend that meets the limit.

When a gasoline or ethanol supply or stream is identified herein as comprising a plurality of batches of multiple gasoline or ethanol types, each batch will be understood to include only one type of gasoline or ethanol. It will also be understood that the plurality of batches originate from multiple locations, and that they have been consolidated into one stream from trunk lines servicing the various origination points. When a gasoline supply or stream is described as varying in volatility potential, it will be understood that the volatility of the gasoline when blended with ethanol will vary over time. The volatility potential of a gasoline can vary due to the content of the gasoline. For example, different gasolines can contain varying amounts and types of aromatic hydrocarbons, and these hydrocarbons can cause the volatility of gasoline when blended with ethanol to vary over time.

When a gasoline/ethanol mix is identified herein as "not passing" one or more volatility limits, or a ratio is identified herein as capable of blending into a sample "without causing the sample to pass" one or more volatility limits, it will be understood that mix neither exceeds nor falls below the limits. For example, when a mix is identified as not passing a minimum volatility limit (such as a minimum distillation temperature), it will be understood that the mix has a volatility that does not fall below that limit. Furthermore, when a mix is identified as not passing a maximum volatility limit (such as a maximum allowable vapor pressure), it will be understood that the mix has a volatility that does not exceed that limit.

Discussion

The invention supports a number of embodiments, each of which are described in greater detail below. Unless otherwise specified, each of the following embodiments can be implemented at any point along a petroleum pipeline—i.e. at the rack, where gasoline is unloaded onto transport tanker trucks ("at the rack" includes both (1) along the line from a storage tank immediately prior to the rack and (2) along the line between a storage tank and an intermediate temporary storage tank immediately prior to the rack), along a consolidated pipeline that transmits multiple types of gasoline from different sources such as refineries or ports, and along a pipeline that transmits only one type of gasoline (as in a line that transmits only one type of gasoline to an above-ground storage tank). The tank farm at which ethanol and butane is blended may be a terminal gasoline tank farm (where tanker trucks are filled), an intermediate gasoline tank farm (from which gasoline is distributed to multiple end locations), or a combined use tank farm (that serves as an intermediate point and a terminal point). In one embodiment, the systems and methods further include transmitting the blended gasoline stream to an above-ground storage tank (i.e. a tank that is permanently constructed on a piece of land, typically with berms around its periphery to contain any petroleum spills) or an intermediate temporary storage tank immediately prior to the rack. The invention provides both methods of blending and the system components for blending, and it will be understood that each method embodiment has a corresponding system embodiment, and that each system embodiment has a corresponding method embodiment.

In a first principal embodiment, the invention is defined as a method of blending butane into a gasoline supply that also is mixed with a fixed ratio of ethanol, in an amount that does not cause the gasoline/ethanol mix to pass one or more fixed volatility limits selected from vapor pressure, vapor liquid ratio, T(10) and T(50), wherein the gasoline supply varies over time in terms of content and volatility potential, comprising:

a. providing (i) a supply of gasoline, (ii) an ethanol standard, and (iii) a supply of butane;
b. analyzing the volatility of a sample formed by mixing the gasoline and ethanol standard;
c. calculating from the volatility a ratio of butane that can be blended into the sample without causing the sample to pass the one or more fixed volatility limits; and
d. blending butane from the butane supply with gasoline from the gasoline supply at or below the ratio calculated in step (c).

In a particular embodiment, the ethanol standard is obtained from the ethanol that is to be mixed at the fixed ratio with the gasoline. Alternatively, the ethanol standard can be obtained from a second supply of ethanol. For example, the ethanol sample can be drawn from a relatively small tank of ethanol installed around the area where the volatility is analyzed. Advantageously, this can allow the butane to be blended before the addition of the ethanol, which can in turn allow the butane to be blended with the gasoline at any location along the gasoline supply chain, including far away from the location of ethanol blending.

Of course, it will also be understood that the invention can be practiced with volatility modifying agents other than butane and ethanol, and that the petroleum product may be gasoline or any other petroleum product. In this embodiment the invention provides a method of blending a first volatility modifying agent (FVMA) into a petroleum supply that is also mixed with a fixed ratio of a second volatility modifying agent (SVMA), in an amount that does not cause the petroleum/SVMA mix to exceed one or more fixed volatility limits, wherein the petroleum supply varies over time in terms of content and volatility potential, comprising:

a. providing (i) a supply of petroleum, (ii) an SVMA standard, and (iii) a supply of FVMA;
b. analyzing the volatility of a sample formed by mixing the petroleum and SVMA standard;
c. calculating from the volatility a ratio of FVMA that can be blended into the sample without causing the sample to pass the one or more fixed volatility limits; and
d. blending FVMA from the FVMA supply with petroleum from the petroleum supply at or below the ratio calculated in step (c).

It also will be understood that the amount of butane or FVMA blended in step (d) can be adjusted based on the ratio of butane that will be present in the final blend. For example, in embodiments where the butane or FVMA is blended with the gasoline upstream of the ethanol blending, the ratio of butane blended in step (d) can be greater than the ratio of butane or FVMA calculated in step (c) by an amount that will allow the butane to be present in the final blend to be at or below the ratio calculated in step (c).

In still another embodiment, the invention is defined as a system, and when used specifically for blending gasoline, butane and ethanol, the invention provides a system for blending butane into a gasoline supply that also is mixed with a fixed ratio of ethanol, in an amount that does not cause the gasoline/ethanol mix to pass one or more fixed volatility limits selected from vapor pressure, vapor liquid ratio, T(10) and T(50), wherein the gasoline supply varies over time in terms of content and volatility potential, comprising:

a. a supply of gasoline, an ethanol standard, and a supply of butane;
b. an analysis system for (i) blending the gasoline sample with an ethanol standard at the fixed ratio to provide an ethanol-blended gasoline sample and (ii) measuring the volatility of the ethanol-blended gasoline sample;

c. an information processing unit (IPU) for calculating from the volatility a ratio of butane that can be added to said ethanol blended gasoline sample without passing the fixed volatility requirement; and d. a blending unit for blending butane from the butane supply with gasoline from the gasoline supply at or below the butane ratio.

In a particular embodiment, the ethanol sample is obtained from the supply of ethanol. Alternatively, the ethanol sample can be drawn from a second supply of ethanol. For example, the ethanol sample can be drawn from a relatively small tank of ethanol installed around the area where the volatility measurement is obtained. Advantageously, this can allow the ratio of butane to be predetermined before the addition of the ethanol, which can in turn allow the butane to be added to the gasoline at any location along the gasoline supply chain, including far away from the location of the final ethanol blending.

The step of blending the ethanol from the ethanol supply, the butane from the butane supply, and the ethanol from the ethanol supply can include blending the three streams simultaneously. For example, the blending step can include blending the three streams at a rack, or at a three-way junction up-steam of the rack.

In another embodiment, the blending step can include blending the three streams sequentially. For example, the blending step can include blending the butane with the gasoline and then blending the ethanol with the butane and gasoline blend. In yet another embodiment, the blending step can include blending the ethanol with the gasoline and then blending the butane with ethanol and gasoline blend. In a different embodiment, the blending step can include blending the butane with the ethanol and then blending the gasoline with the ethanol and butane blend. In a particular embodiment, the gasoline and butane are blended upstream from where the ethanol is blended with the butane and gasoline blend.

The method can further include providing an information processing unit (IPU) on which the calculating is performed; transmitting the volatility and the fixed volatility requirement to the IPU; and calculating the ratio of butane on the IPU based upon the fixed volatility requirement and the volatility. The method also can include providing a blending unit in which the blending is performed; transmitting a signal that corresponds to the ratio of butane from the IPU to the blending unit; and blending the butane from the butane supply, the ethanol from the ethanol supply, and the gasoline from the gasoline supply in the blending unit based upon the signal from the IPU.

Numerous methods exist for calculating the ratio of butane that can be blended with a mixture of a given volatility. U.S. Pat. Nos. 7,032,629 and 6,679,302, PCT Patent Application No. WO 2007/124058, and U.S. Patent Application No. 2006/0278304, the contents of which are hereby incorporated by reference, describe such methods of calculation. The blend ratio of butane to gasoline required to attain the fixed volatility can be determined simply by direct volumetric averaging of the volatility of the butane and ethanol-blended gasoline. However, it has been noted in the literature that volumetric averaging can yield low estimates of resultant volatility, especially when the amount of butane added is less than 25%. Methods for determining blend ratios to attain a prescribed volatility which overcome these observed limitations on volumetric averaging are set forth more fully in "How to Estimate Reid Vapor Pressure (RVP) of Blends," J. Vazquez-Esparragoza, Hydrocarbon Processing, August 1992; and "Predict RVP of Blends Accurately," W. E. Stewart, Petroleum Refiner, June 1959; and "Front-End Volatility of Gasoline Blends," N. B. Haskell et al., Industrial and Engineering Chemistry, February 1942, the disclosure from each being hereby incorporated by reference as if fully set forth herein. Moreover, it should be noted that the system of the present invention can be modified to periodically sample the volatility of the resultant blend for quality control, when quality control is of concern.

In a second principle embodiment, the invention provides a system for blending butane, ethanol, and gasoline. The system employs an analyzing unit to measure the volatility of a gasoline sample and an ethanol sample blended at a fixed ratio, and an information processing unit to calculate a ratio of butane that can be added to ethanol-blended gasoline that will meet a fixed volatility requirement. Therefore, in a second principal embodiment the invention provides a system for blending butane, ethanol, and gasoline, comprising (a) a supply of gasoline; (b) a supply of ethanol; (c) a supply of butane; (d) a gasoline outlet for drawing a gasoline sample from the supply of gasoline; (e) an analyzing system for (i) blending the gasoline sample with an ethanol sample at the fixed ratio to provide an ethanol-blended gasoline sample and (ii) measuring the volatility of the ethanol-blended gasoline sample with an analyzing unit; (f) an information processing unit (IPU) for calculating from the volatility a ratio of butane that can be added without exceeding the fixed volatility requirement; and (g) a blending unit for blending butane from the butane supply with gasoline from the gasoline supply at or below the butane ratio.

In a particular embodiment, the analyzing unit can generate a volatility signal based on the volatility, and the IPU can receive the volatility signal and calculate the ratio of butane based upon the volatility derived from the volatility signal. Furthermore, the IPU can generate a blending signal based on the ratio of butane; and the blending unit can receive the blending signal and blend the butane, ethanol, and gasoline based upon the signal from the IPU.

The analyzing system can include (i) a sample control and (ii) a gasoline sample piston pump and an ethanol sample piston pump, and the sample control can adjust the ratio of the gasoline sample and the ethanol sample blended upstream of the analyzing unit with the gasoline sample piston pump and the ethanol sample piston pump. Similarly, the blending unit can comprise (i) a blending control and (ii) a gasoline injector, an ethanol injector, and a butane injector, and the blending control can receive the blending signal and adjust the ratio of butane, gasoline, and ethanol blended in the blending unit with the gasoline injector, the ethanol injector, and the butane injector. In other embodiments, the analyzing system can control the blending of the sample with metered valves instead of piston pumps, and the blending unit can adjust the ratio of butane, gasoline, and ethanol with metered valves instead of injectors.

The methods and systems of the present invention can employ data and programming that takes into account regulatory limits on volatility based on the time of year and geographical region, and automatically vary the blend ratio based on those limits. In a particular embodiment, the method can further comprise storing, in one or more informational databases, seasonal data that prescribes the fixed volatility requirement on two or more prescribed dates or ranges of dates; and calculating the ratio of butane based upon current date information and the seasonal data. Likewise, in a particular embodiment, the system can further comprise one or more informational databases storing seasonal data that prescribes the fixed volatility requirement on two or more prescribed dates or ranges of dates. The IPU can receive this seasonal data, and calculate the ratio of butane based upon current date information and the seasonal data.

Preferably, the ratio at which the methods and systems of the present invention blend the gasoline sample and ethanol sample before measuring the volatility is the same as the ratio at which the gasoline stream and the ethanol stream are blended. For example, in particular embodiments, the gasoline sample and the ethanol sample are blended at a fixed ratio of 9 to 1, the volatility of the ethanol-blended gasoline sample is measured, and a ratio of butane is calculated that can be blended with a 9 to 1 gasoline to ethanol mixture to meet a fixed volatility requirement.

The fixed ratio can be essentially any ratio. Suitable ranges for the ratio of gasoline to ethanol include between about 95:5 to about 5:95, about 90:10 to about 60:40, about 90:10 to about 80:20, about 10:90 to about 40:60, and about 20:80 to about 50:50. For blends that contain primarily gasoline, suitable ranges for the ratio of gasoline to ethanol include between about 95:5 to about 50:50, and more preferably about 90:10 to about 80:20. For blends that contain primarily ethanol, suitable ranges for the ratio of gasoline to ethanol include between about 5:95 to about 50:50, and more preferably about 1:90 to about 20:80. In a preferred embodiment, the ratio is about 9:1 gasoline to ethanol. In other embodiments, the ratio can be about 5:1 gasoline to ethanol or about 1:5 gasoline to ethanol. Other suitable ratios include about 9:1, about 4:1, about 1:1, about 1:4, about 15:85, and about 1:9.

The volatility is preferably measured as a vapor pressure, a vapor liquid ratio, a distillation temperature requirement, or combinations thereof. The vapor pressure requirement can comprise a maximum allowable vapor pressure, a minimum allowable vapor pressure, a maximum allowable vapor liquid ratio, a minimum allowable vapor liquid ratio, or a minimum allowable distillation temperature. In particular embodiments, the minimum allowable distillation temperature can comprise a minimum T(50), a minimum T(10), or both a minimum T(50) and a minimum T(10).

In a particular embodiment, the volatility measurement comprises a vapor pressure measurement and a distillation temperature measurement, and the volatility requirement comprises a maximum allowable vapor pressure and a minimum allowable distillation temperature. The ratio of butane can then be calculated so that the final blend meets both the maximum allowable vapor pressure and the minimum allowable distillation temperature.

In a particular embodiment, the volatility can be measured by an analyzing unit that includes an analyzer such as a Grabner unit or a Bartec Distillation Process Analyzer (DPA). For example, the analyzing unit can include a Grabner unit for obtaining vapor pressure and vapor liquid ratio measurements, and a Bartec unit for obtaining distillation temperature measurements. In particular embodiments, a Grabner unit can be used to obtain volatility measurements on a periodic basis of about 3 to about 5 times per hour, and a Bartec unit can used to obtain volatility measurements on a periodic basis of about 2 times per hour.

In a particular embodiment, the gasoline sample and the ethanol sample are blended and then the ethanol-blended gasoline sample is placed in the analyzing unit. In another embodiment, the gasoline sample and the ethanol sample are blended within the analyzing unit. As used herein, the term "analyzing system" refers to the system for blending the gasoline sample and ethanol sample and obtaining the volatility measurement, regardless of whether the blending of the samples occurs within the analyzing unit.

Any of the foregoing data, including the fixed volatility requirements, volatility measurements, and ratio of butanes can be stored in a database accessible to a remote location through a dedicated or Internet connection. Furthermore, any of the data or signals encoding the data can be transmitted via dedicated or internet connections between the components of the system.

In a particular embodiment, the sampling, measuring and blending steps and systems are located in close proximity to one another. For example, the sampling, measuring and blending systems can be housed on a discreet, permanently mounted skid or platform. Alternatively, the sampling, measuring and blending steps and systems are located in different locations. For example, the sampling and measuring steps can occur at any location upstream of the blending. Furthermore, the blending step can occur either at a single location or at multiple locations. For example, in one embodiment, the blending of the butane and gasoline can occur in any location upstream of the ethanol blending. In an alternative embodiment, the blending of the butane, ethanol, and gasoline occur at a single location.

Referring now to the drawings, FIG. 1 illustrates a functional block diagram of the architecture and components of an exemplary embodiment of a butane, ethanol, and gasoline blending system. The butane supply 200 comprises a butane tank 205, an inlet line 210, a pump back line 215 and an outlet line 220. The butane tank 205 is filled with butane through the inlet line 210. The butane supply 200 may further comprise one or more pressure safety valves 225, a level indicator 230, a temperature gauge 235, and a pressure gauge 240.

Butane is supplied to the blending skid 140 by the outlet line 220. The butane supply 200 may further comprise a bypass line 245 in fluid connection with the butane tank 205 and the outlet line 220. The bypass line 245 is operable for maintaining constant pressure in the outlet line 220.

The gasoline supply 110 is stored in one or more gasoline tanks 255 at the tank farm. Different tanks may contain different grades of gasoline (for example, PBOB, RBOB, CBOB, sub-grade, and PLUS). Gasoline is provided through one or more gasoline lines 260.

To determine the amount of butane to include in the gasoline supply 260, a sample of gasoline is drawn from an outlet line 265 and into a sample selection station 270. Generally, one or more pumps 275 draws the gasoline samples from gasoline supply 260, through the sample selection station 270, and into the analyzer sampling conditioning station 280. At the same time, a sample of ethanol is drawn from an ethanol supply 285 through an outline line 290. The gasoline sample and ethanol sample are then drawn into a blending skid 295, which combines the samples into a single sample stream 300. The sample stream 300 passes through a static mixer 305, and enters an analyzer 310, which determines the volatility of the sample.

After the analyzer 310 takes measurements, the samples enter a sample retention station 311. The sample retention station 311 can include a sample retention tank 312 for retaining samples. The sample retention station 311 can further include a sample pump 313 for returning the samples from the tank 312 to the one or more gasoline lines 260 through a return line 315.

Once the volatility of the samples is measured, the analyzer 310 sends measurement data for the samples to the processor. The processor calculates the amount of butane that can be blended with the gasoline. The processor can comprise one or more programmable logic controllers (not shown) that control one or more blending units 320. The blending units 320 include injection stations 325 that are connected to the outlet line 220 and control the flow of butane into the gasoline lines 260. In a particular embodiment, the injection stations 325 comprise a mass meter 330 and a control valve 335. The blended gasoline then flows through the gasoline line 260.

Figure 2:
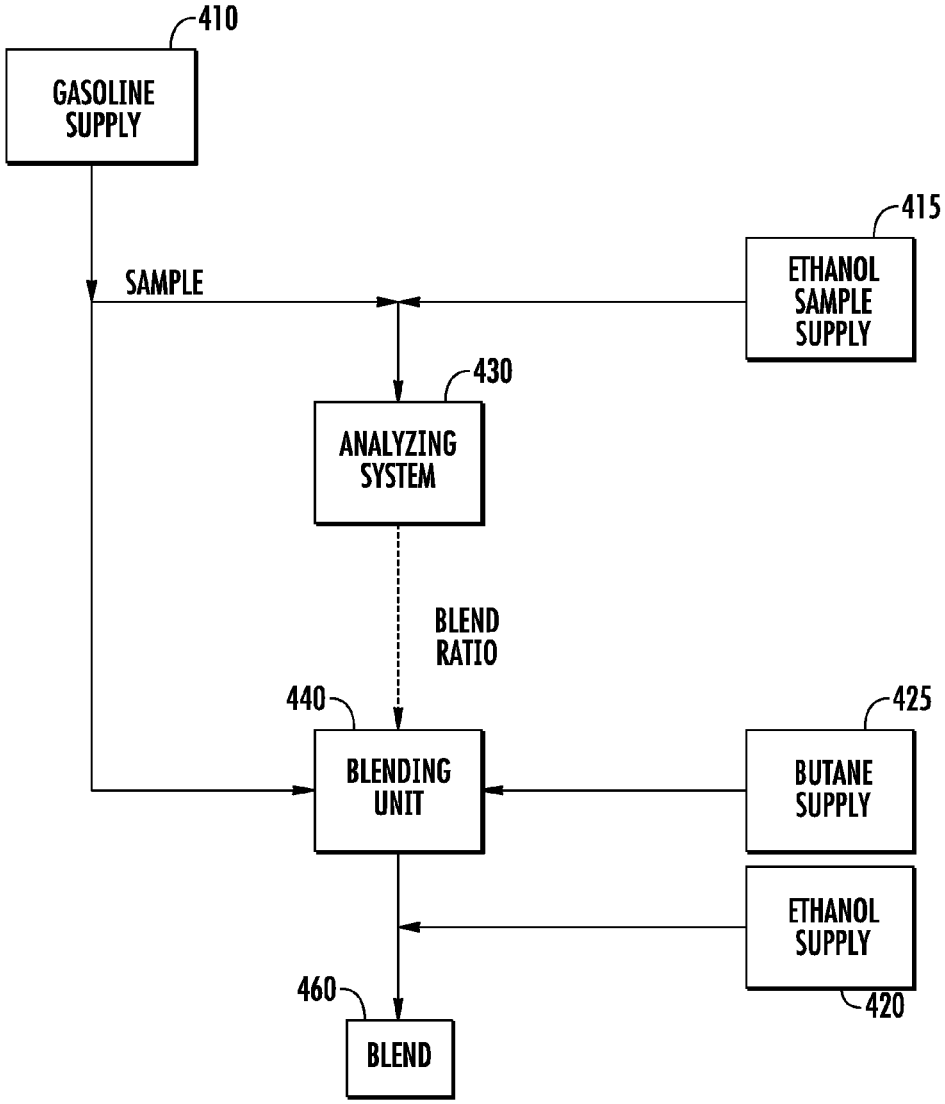
FIG. 2 is a functional block diagram illustrating an overview of the architecture of an exemplary embodiment of a butane, ethanol, and gasoline blending system.

Referring again to the drawings, FIG. 2 illustrates a functional block diagram of the architecture of an exemplary embodiment of a butane, ethanol, and gasoline blending system. A gasoline supply 410 provides a gasoline stream, an ethanol sample supply 415 provides an ethanol sample, an ethanol supply 420 provides an ethanol stream, and a butane supply 425 provides a butane stream. A gasoline sample is drawn from the gasoline stream and is blended with the ethanol sample outside an analyzing system 430. The analyzing system 430 measures the volatility and calculates a ratio of butane. The ratio of butane is transmitted to a blending unit 440, and the blending unit 440 blends the gasoline stream, the ethanol stream, and the butane stream to produce a blend 460.

Figure 3:
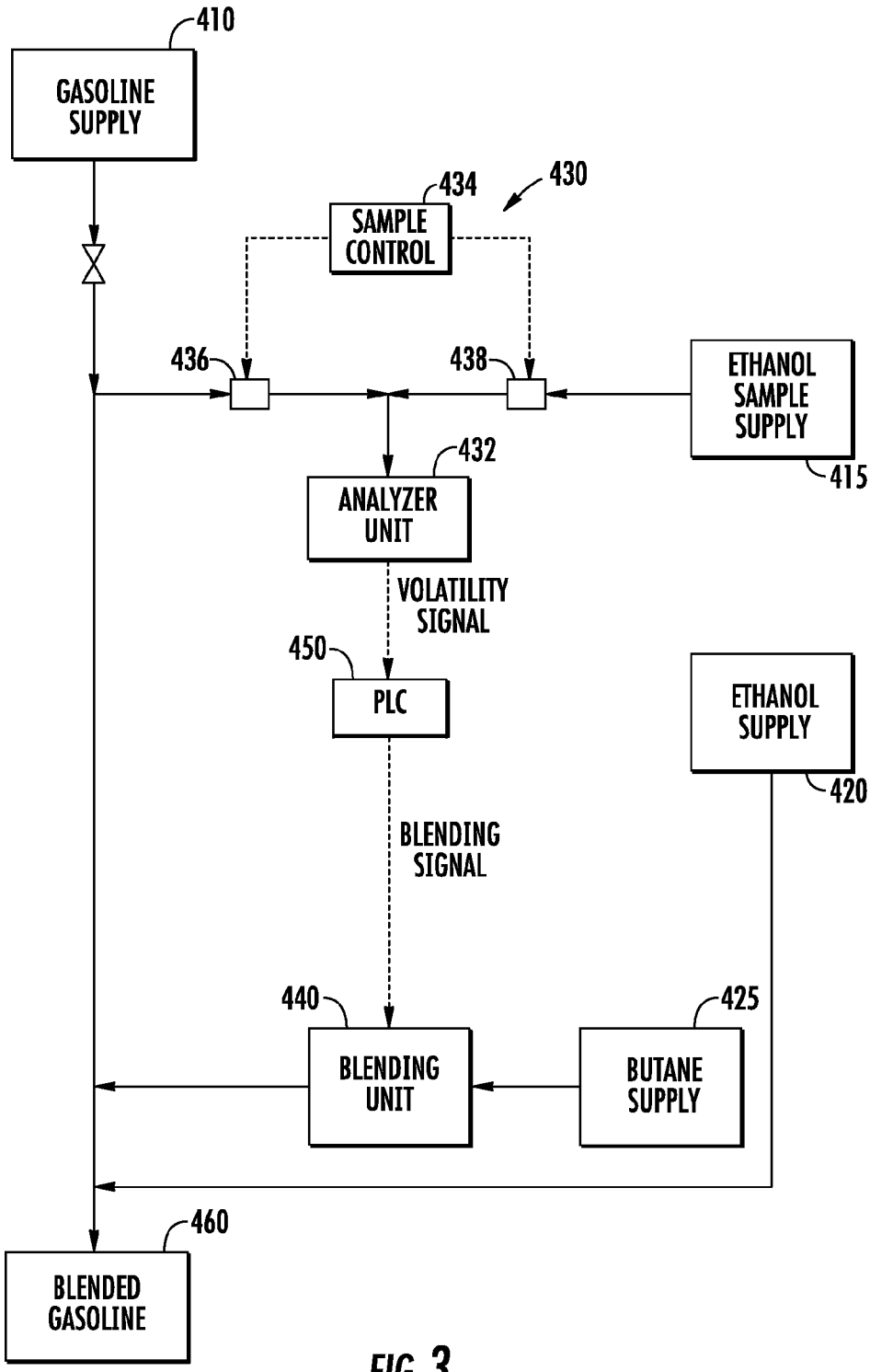
FIG. 3 is a functional block diagram illustrating an overview of the architecture of an exemplary embodiment of a butane, ethanol, and gasoline blending system.

Referring yet again to the drawings, FIG. 3 illustrates a functional block diagram of the architecture of an exemplary embodiment of a butane, ethanol, and gasoline blending system. The gasoline supply 410 provides a gasoline stream, the ethanol sample supply 415 provides an ethanol sample, the ethanol supply 420 provides an ethanol stream, and a butane supply 425 provides a butane stream. A gasoline sample is drawn from the gasoline stream and blended with the ethanol sample within the analyzing system 430. The analyzing system 430 includes an analyzer unit 432, a sample control 434, a gasoline sample piston pump 436, and an ethanol sample piston pump 438. The sample control 434 sends signals that control the piston pumps 436 and 438 so that the gasoline sample and the ethanol sample can be blended at a predetermined ratio before entering the analyzer unit 432.

The analyzer unit 432 measures the volatility of the ethanol-blended gasoline sample and generates a volatility signal that is received by a PLC 450. The PLC 450 receives the volatility signal, and calculates the ratio of butane based upon the volatility measurement derived from the volatility signal, and generates a blending signal.

The blending signal is used by the blending unit 440 to determine how to blend the butane stream from the butane supply 425 into the gasoline stream from the gasoline supply 410.

The present invention may be understood more readily by reference to the following non-limiting Example.

EXAMPLE

The following iterative procedure described in "How to Estimate Reid Vapor Pressure (RVP) of Blends," J. Vazquez-Esparragoza, Hydrocarbon Processing, August 1992, can be used to predict the RVP of a mixture of hydrocarbon components. Importantly, the procedure can be used for hydrocarbon components defined by either their chemical composition or their physical properties. For this reason, it can be used to calculate the volatility of a blend of (1) butane, which has a known chemical composition, and (2) a mixture of gasoline and ethanol, which has an unknown chemical composition, but can be defined by its physical properties obtained from a volatility analysis. Advantageously, the algorithm can by implemented in a computer simulation.

Step 1. Calculate the molecular weight (MW) of the sample mixture:

$$MW_{mix}=\Sigma_i x_1 MW_i$$

Step 2. Evaluate the density (ρ) of the sample at T=35, 60, and 100° F. Compute the liquid expansion of the sample using n=4:

$$V_o=\rho_{60}((n+1)/\rho_{35}-1/\rho_{100})$$

Step 3. Make a flash calculation at 100° F. For the first calculation, assume an initial ratio of the equilibrium liquid L and feed liquid F so that L/F=0.97.

Step 4. Using the values from step 3, calculate a new L/F with the equation:

$$L/F=1/(1+(\rho_v MW_L/\rho_L MW_V)(V_o/(\rho_V/\rho_{LF})))$$

Step 5. Use the value of L/F from step 4 to recalculate the flash from step 3 and a new value of L/F from step 4. In most cases, the assumed and calculated values agree within the specified criterion within less than five iterations.

Step 6. The RVP is the flash pressure for the value of L/F obtained by iteration.

Throughout this application, various publications are referenced. The disclosures of these publications are hereby incorporated by reference in order to more fully describe the state of the art to which this invention pertains. It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of blending a first volatility modifying agent (FVMA) into a petroleum supply that also is mixed with a fixed ratio of ethanol, in an amount that does not cause the petroleum/ethanol mix to exceed one or more fixed volatility limits, wherein the petroleum supply varies over time in terms of content and volatility potential, comprising:

a. providing (i) a supply of petroleum, (ii) an ethanol standard, and (iii) a supply of FVMA;

b. analyzing the volatility of a sample formed by mixing the petroleum and ethanol standard;

c. calculating from the volatility a ratio of FVMA that can be blended into the sample without causing the sample to pass the one or more fixed volatility limits; and d. blending FVMA from the FVMA supply with petroleum from the petroleum supply at or below the ratio calculated in step (c).

2. The method of claim 1, wherein the petroleum supply comprises a plurality of batches of different petroleum types selected from: unleaded gasoline having an octane rating of 80 or greater, transmix, jet fuel, BOB, subgrade, and diesel fuel.

3. The method of claim 1, wherein the petroleum/ethanol mix comprises a gasoline:ethanol ratio in the range of 95:5 to 5:95.

4. The method of claim 1, wherein the petroleum/ethanol mix comprises a gasoline:ethanol ratio in the range of 90:10 to 60:40.

5. The method of claim 1, wherein the petroleum/ethanol mix comprises a gasoline:ethanol ratio in the range of 90:10 to 80:20.

6. The method of claim 1, wherein the petroleum comprises gasoline.

7. The method of claim 1, wherein the FVMA comprises butane.

* * * * *